US005334071A

United States Patent [19]

Mills

[11] Patent Number: 5,334,071

[45] Date of Patent: Aug. 2, 1994

[54] STEAM LOCOMOTIVE-WHISTLE MODEL AND TOY

[76] Inventor: Percy E. Mills, 139 Main St., Whitsett, Pa. 15473

[21] Appl. No.: 27,653

[22] Filed: Mar. 8, 1993

[51] Int. Cl.[5] ..... A63H 29/16; A63H 5/00

[52] U.S. Cl. ..... 446/186; 446/203; 446/188; 446/206

[58] Field of Search ..... 446/186, 192–196, 446/199, 200, 202, 203, 205, 206, 216

[56] References Cited

U.S. PATENT DOCUMENTS

| | | | |
|---|---|---|---|
| 153,103 | 7/1874 | Minich | 446/202 |
| 661,252 | 11/1900 | Shortridge | 446/186 |
| 1,383,878 | 7/1921 | Taylor | 446/206 |
| 2,677,213 | 5/1954 | Wechsler | 446/186 |
| 3,628,280 | 12/1971 | Nave | 446/200 |

*Primary Examiner*—Danton D. DeMille
*Attorney, Agent, or Firm*—William J. Ruano

[57] ABSTRACT

A steam locomotive-whistle model and toy providing realism in appearance in sound and operation of a real locomotive, by responding to blowing effort by the mouth or of a balloon which operates parts to run the locomotive and to emit sounds exactly simulating those of a real locomotive. It includes a smokestack and detachable cover, simulating smoke, to prevent air from escaping through its inlet hole. Also it includes a rear air intake pipe which is blown by the mouth to force air into an air chamber, thence into air ports and a cylinder to cause a piston to move away from the air inlet end of the cylinder.

8 Claims, 2 Drawing Sheets

STEAM LOCOMOTIVE-WHISTLE MODEL AND TOY

BACKGROUND OF THE INVENTION

In the past, locomotive models and toys have not been truly realistic either in appearance or sound because of their construction.

SUMMARY OF THE INVENTION

A locomotive-whistle model and toy of a construction to provide realism not only in appearance but in sound and operation of a real locomotive. This is done by a construction responding to blowing effort by the mouth or of a balloon which operates parts to run the locomotive and to emit sounds exactly simulating that of a real locomotive.

DESCRIPTION OF THE PREFERRED EMBODIMENT

Figure 1:
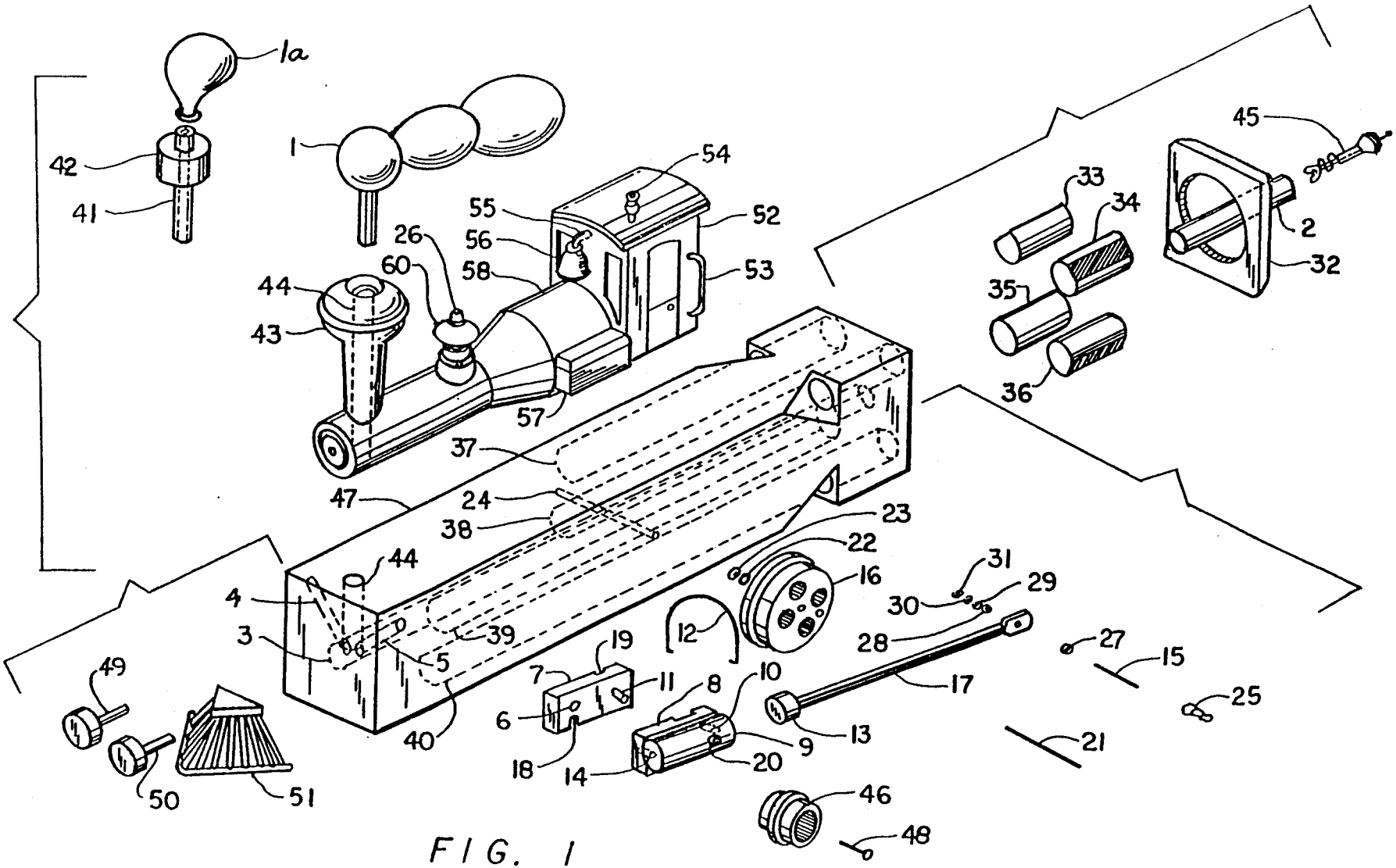
FIG. 1 is an exploded view of a locomotive-whistle model and toy embodying the invention.
Figure 2:
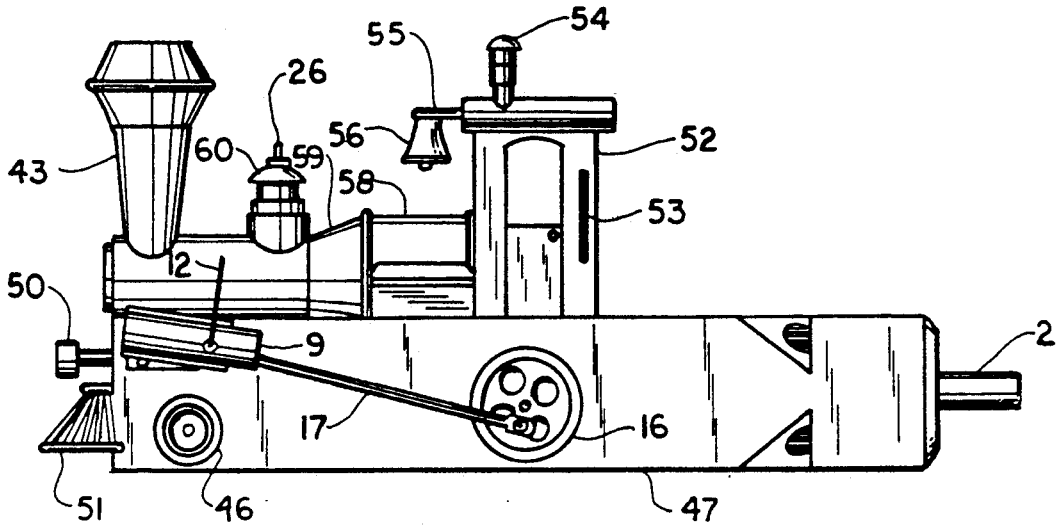
FIG. 2 is a side view thereof, the opposite side being identical.
Figure 3:
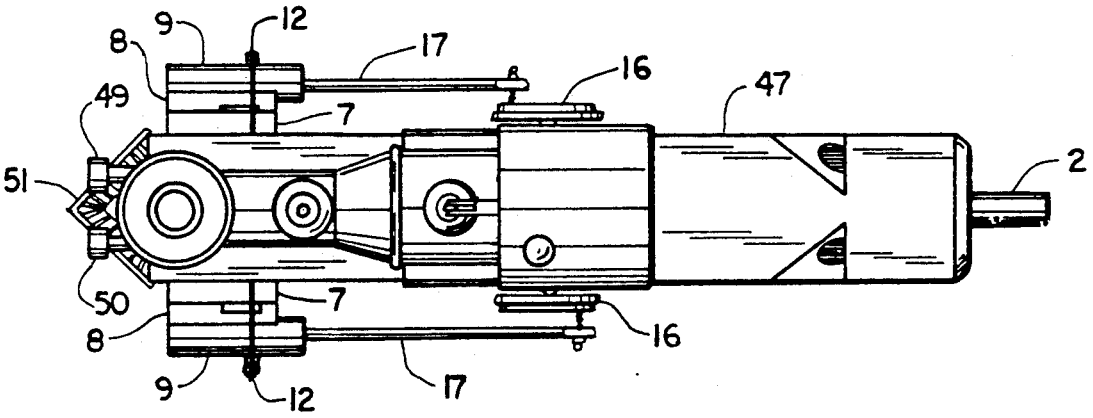
FIG. 3 is a top view thereof.

Referring to FIGS. 1, 2 and 3 of the drawings, the first mode of operation is as follows:

During this mode of operation, the simulated smoke 1 (FIG. 1) is in place on the locomotive smokestack 43 to prevent air from escaping through the smokestack inlet hole 44. Blowing by the mouth into the rear air intake pipe 2 forces air into the air chamber 3. The air is forced from the air chamber 3 into the air ports 4 and 5. From port 5 the air is forced into the air intake hole 6 of the main valve plate 7. The main valve plate 7 is stationary and glued permanently to the side of the locomotive base whistle block 47 with its air intake hole 6 aligned with the air port hole 5.

The cylinder valve plate 8 and cylinder 9 are permanently attached together side-by-side to form one unit. The pivot pin sleeve 10 of the cylinder valve plate 8 is placed over the pivot pin 11 of the main valve plate 7. The two valve plates 7 and 8 are held together, side-by-side, by the tension retaining spring 12 which hooks retainer hole 20 on one side and a similar recessed side hole inside spring retainer and slot 19 on the other side of plate 7.

At the beginning of the cycle, the piston 13 is in the cylinder 9 as far as it can go, and the air intake hole 14 of the cylinder valve plate 8 is aligned with the air intake hole 6 of the main valve plate 7. Air is then forced into the cylinder 9 causing the piston 13 to move away from the air inlet end of the cylinder 9.

The piston 13 is connected to the crank pin 15 of the driving wheel 16 by a piston rod 17. The piston 13 and piston rod 17 are permanently attached to each other to form one rigid unit. Their movement forces the driving wheel 16 to rotate. The momentum of the driving wheel 16, attached to the crank pin 15, causes the crank pin 15 to keep rotating. This rotation causes the cylinder valve plate 8 and cylinder 9 assembly to swivel on the pivot pin 11, shutting off the air supply from the air intake hole 6 of the main valve plate 7. Thus, the piston 13 is forced back to the beginning point.

The trapped air in the cylinder 9 is forced out of the exhaust port 18 as the piston 13 moves back to the starting point. The cycle is now completed. The continual rotation also causes the cylinder valve plate 8 and the cylinder 9 assembly to swivel on the pivot pin 11, once again allowing the air supply from the air intake hole 6 of the main valve plate 7 to flow into the cylinder 9 and another cycle begins.

This locomotive is equipped with dual cylinders. The right cylinder functions identically to the left cylinder described above and receives its air pressure from the right port 4. The cylinders are synchronized. When one is receiving air the other is exhausting air. This gives the locomotive continuous power.

The locomotive whistle can be blown in this mode of operation by simply parting the lips and covering the outer perimeter of the large hole in the whistle air control block 32 and pressing the locomotive to the mouth so the air flow will pass into all four tone holes 37, 38, 39 and 40 simultaneously to make a distinctive locomotive whistle sound. Due to the loss of air that operates the four whistles 37, 38, 39 and 40, during this mode of operation, insufficient pressure can be built up to activate the mechanical function of the locomotive and whistle simultaneously.

By changing the position of the mouth, the mechanical function or the whistle can be activated independently of each other. In this mode of operation, if the simulated smoke 1 is not in place on the smokestack 43, the whistle can be blown but the mechanical function cannot be activated.

The second mode of operation is as follows:

During this mode of operation, the balloon holder 41 is fitted with two nine-inch, good quality balloons. One balloon is placed inside the other with the eraser end of a pencil or similar object. The open end of the balloons are pulled down over the balloon retaining ring 42 of the balloon holder 41. The balloon is then inflated and inserted into the smokestack 43 while pinching the neck of the balloon. When released, the air pressure from the balloon enters the smokestack inlet hole 44 forcing air into the air chamber 3 and air ports 4 and 5.

A check valve 45 located in the rear air intake pipe 2 prevents air from escaping. From this point the air then takes the same path as described in Mode 1 causing the same mechanical movements.

While the air from the balloon is operating the mechanical function of the locomotive, the whistle can be blown as stated in Mode 1 at any time. While the balloon is inflated and operating the mechanical function of the locomotive, air can be blown into the intake pipe 2 stabilizing or further inflating the balloon while the mechanical function of the locomotive is not interrupted. While the balloon is inflated and in place on the smokestack 43, the locomotive can be held or placed on any flat surface and the mechanical function will continue until the balloon is deflated.

The leading wheel 46 with simulated capped axle 48 is stationary and glued permanently to the side of the locomotive base whistle block 47. The right side of the locomotive has an identical wheel.

The axle for driving wheels 21 turns freely in axle sleeve 24 and is fitted with driving wheel washer 22 and driving wheel spacer 23 between locomotive base whistle block 47 and driving wheel 16. The end of axle for driving wheels 21 is permanently attached in the center hole of driving wheel 16.

Crank pin 15 is permanently attached in the smaller outer hole of driving wheel 16 and is fitted with piston rod washers 28, 31 and piston rod spacers 29 and 30 between driving wheel 16 and piston rod 17. Crank pin 15 is fitted with piston rod washer 27 between piston rod 17 and piston rod retainer 25. Piston rod retainer 25 is adjustable and attached to the end of crank pin 15.

Whistle plugs 33, 34, 35 and 36 are identical and permanently placed in the ends of tone holes 37, 38, 39 and 40 to control the air flow for the whistle tones.

Buffers 49, 50 and pilot 51 are permanently attached to the end of locomotive base whistle block 47 to give an authentic front end appearance of a locomotive. Cab 52, firebox 58, boiler 59, and smokestack 43 are permanently attached to the top of the locomotive base whistle block 47 to give an appearance of an authentic locomotive. The appearance is further enhanced by adding hand grip 53, cab ventilator 54, bell support beam 55, bell 56, tool container 57, safety valve 26 and steam dome 60.

I claim:

1. A steam locomotive-whistle model and toy comprising an air chamber a smoke-stack in air communication with said chamber and a detachable, solid closure member therefor simulating smoke, which closure member, when in place, prevents air from escaping said chamber through said smokestack; a rear intake pipe which when blown by the mouth forces air into said air chamber; a reciprocating piston and cylinder drive in air communication with said air chamber on each side of said model and toy, whereby upon selective introduction of air through either said smokestack or rear intake pipe and said reciprocating piston and cylinders, said reciprocating piston and cylinders will operate from the movement of air.

2. Apparatus as recited in claim 1, together with a whistle block through which said air chamber extends centrally thereof, said whistle block having a plurality of longitudinally extending holes of different lengths and having a rear opening through which air is blown by the mouth through said plurality of longitudinally extending holes to effect whistling.

3. Apparatus as recited in claim 2 wherein said rear opening surrounds said rear intake pipe.

4. Apparatus as recited in claim 1 together with a balloon attachable to said smokestack for blowing air into said air chamber to effect drive of said reciprocating piston and cylinder drives.

5. Apparatus as recited in claim 4 wherein air is blown also by mouth through said rear intake pipe thereby stabilizing or further inflating said balloon without interruption of the drives of said reciprocating pistons and cylinders.

6. Apparatus as recited in claim 4 together with blowing by mouth through said rear opening of said whistle block so as to also effect whistling during said drives of said reciprocating pistons and cylinders.

7. Apparatus as recited in claim 1 wherein each of said reciprocating pistons and cylinders comprises a main valve plate, a cylinder valve plate and a cylinder attached together, spring means for yieldingly holding said main valve plate to said cylinder valve plate, pivotal means to enable pivotal movement of said cylinder valve plate and cylinder relative to said main valve plate.

8. Apparatus as recited in claim 2 together with a plurality of longitudinally extending whistle plugs extending through longitudinal holes at the rear of said whistle block, each plug having a flat side to restrict the air openings through said whistle block.

* * * * *